US012745816B2

(12) United States Patent
Storey et al.

(10) Patent No.: US 12,745,816 B2
(45) Date of Patent: Sep. 29, 2026

(54) HELMET

(71) Applicant: GEORGE TFE SCP, Monaco (MC)

(72) Inventors: Piers Christian Storey, Niece (FR); John George Lloyd, Monaco (MC)

(73) Assignee: GEORGE TFE SCP, Monaco (MC)

( * ) Notice: Subject to any disclaimer, the term of this patent is extended or adjusted under 35 U.S.C. 154(b) by 180 days.

(21) Appl. No.: 17/782,646

(22) PCT Filed: Dec. 15, 2020

(86) PCT No.: PCT/EP2020/086148
§ 371 (c)(1),
(2) Date: Jun. 4, 2022

(87) PCT Pub. No.: WO2021/122546
PCT Pub. Date: Jun. 24, 2021

(65) Prior Publication Data

US 2023/0011532 A1 Jan. 12, 2023

(30) Foreign Application Priority Data

Dec. 18, 2019 (EP) ..... 19020703

(51) Int. Cl.
*A42B 3/12* (2006.01)

(52) U.S. Cl.
CPC ..... *A42B 3/124* (2013.01); *A42B 3/125* (2013.01)

(58) Field of Classification Search
CPC ..... A42B 3/124; A42B 3/128; A42B 3/063; A42B 3/064
See application file for complete search history.

(56) References Cited

U.S. PATENT DOCUMENTS 4,006,496 A * 2/1977 Marker ..... A42B 3/128 2/414
4,599,752 A * 7/1986 Mitchell ..... A42B 3/32 2/425
5,337,420 A * 8/1994 Haysom ..... A42B 3/14 2/181
6,094,750 A * 8/2000 Lee ..... A42B 3/281 2/412
6,332,228 B1 * 12/2001 Takahara ..... A42B 3/003 2/425

(Continued)

FOREIGN PATENT DOCUMENTS

DE 29917109 U1 1/2000
EP 3422887 A1 1/2019

(Continued)

OTHER PUBLICATIONS

International Search Report dated Mar. 25, 2021 received for PCT application n. PCT/EP2020/086148.

(Continued)

*Primary Examiner* — Alissa L Hoey
(74) *Attorney, Agent, or Firm* — Jason L DeFrancesco

(57) ABSTRACT

Helmet (1) comprising a first protective collapsible portion (2), a second protective collapsible portion (4), and at least one energy absorbing pad (3) permeable to air arranged between said first and second protective collapsible portions (2,4), wherein the first collapsible portion (2) and the second collapsible portion (4) are coupled to each other through one or more mechanical couplings (11-16).

11 Claims, 10 Drawing Sheets

(56) References Cited

U.S. PATENT DOCUMENTS 8,955,169 B2 * 2/2015 Weber ..... A42B 3/125 2/425
9,210,962 B2 * 12/2015 Ho ..... A42C 2/002
9,408,423 B2 * 8/2016 Guerra ..... A42B 3/125
9,474,313 B2 * 10/2016 Kamradt ..... F16F 3/093
10,362,829 B2 * 7/2019 Lowe ..... A42B 3/128
10,433,610 B2 * 10/2019 Lee ..... A42B 3/063
10,561,189 B2 * 2/2020 Lee ..... A42B 3/28
10,561,192 B2 * 2/2020 Weber ..... A42B 3/064
10,736,373 B2 * 8/2020 Chilson ..... A42B 3/124
10,798,985 B2 * 10/2020 Manera ..... A42B 3/125
10,806,201 B2 * 10/2020 Morgan ..... A41D 31/285
10,813,402 B2 * 10/2020 Posner ..... A42B 3/064
10,834,987 B1 * 11/2020 Bottlang ..... A42B 3/125
10,881,161 B2 * 1/2021 Jacobsen ..... A42B 3/283
10,893,717 B2 * 1/2021 Pomering ..... A42B 3/064
11,191,315 B2 * 12/2021 Von Dunten ..... A42B 3/283
11,304,471 B2 * 4/2022 Light ..... B29C 64/10
11,396,922 B2 * 7/2022 Abdolahian ..... A42B 3/124
11,419,380 B2 * 8/2022 Shaffer ..... A42B 3/14
11,517,063 B2 * 12/2022 Boutin ..... A42B 3/065
11,730,223 B2 * 8/2023 Pomering ..... A42B 3/0406 2/416
11,730,224 B2 * 8/2023 Rietdyk ..... A42B 3/128 2/414
11,812,810 B2 * 11/2023 Pomering ..... A42B 3/064
12,150,510 B2 * 11/2024 Storey ..... A42B 3/065
2001/0032351 A1 * 10/2001 Nakayama ..... A42B 3/064 2/412
2006/0059606 A1 * 3/2006 Ferrara ..... A01N 25/18 2/412
2009/0255036 A1 * 10/2009 Lim ..... A42B 3/10 2/181
2014/0123360 A1 * 5/2014 Cohen ..... F41H 1/04 2/6.6
2015/0047110 A1 2/2015 Chilson et al.
2015/0250248 A1 9/2015 Jacobsen
2015/0264991 A1 * 9/2015 Frey ..... A42B 3/064 2/411
2015/0305430 A1 * 10/2015 Rush ..... A42B 3/124 2/412
2016/0021965 A1 * 1/2016 Mayerovitch ..... A42B 3/064 2/414
2016/0088884 A1 * 3/2016 Guerra ..... A63B 71/1225 2/455
2018/0027914 A1 * 2/2018 Cook ..... A42B 3/12
2018/0213874 A1 * 8/2018 Lanner ..... A42B 3/127
2018/0255861 A1 * 9/2018 Ho ..... A42B 3/124
2018/0255862 A1 * 9/2018 Ho ..... A42B 3/064
2019/0090574 A1 * 3/2019 Shaffer ..... A42B 3/08
2019/0231018 A1 * 8/2019 Boutin ..... A42B 3/124
2020/0022444 A1 * 1/2020 Stone ..... A42B 3/065
2021/0037905 A1 * 2/2021 Ward ..... A42B 3/14
2021/0085013 A1 * 3/2021 Czerski ..... A42B 3/063
2021/0100310 A1 * 4/2021 Kim ..... A42B 3/124
2021/0187897 A1 * 6/2021 Reinhall ..... B32B 27/08
2021/0315307 A1 * 10/2021 Zouzias ..... A42B 3/128
2021/0323263 A1 * 10/2021 Cagle ..... B32B 15/14
2022/0232924 A1 * 7/2022 Cook ..... A42B 3/064
2022/0248792 A1 * 8/2022 Mazzarolo ..... A42B 3/064
2022/0386733 A1 * 12/2022 Merlo ..... A41D 13/0156
2023/0010873 A1 * 1/2023 Storey ..... A42B 3/064
2023/0061962 A1 * 3/2023 Dumph ..... A42B 3/064
2023/0072088 A1 * 3/2023 von Holst ..... A01L 1/00
2023/0180880 A1 * 6/2023 Melofchik ..... A42B 3/283 2/411
2023/0320450 A1 * 10/2023 Wiart ..... A42B 3/12 2/411

FOREIGN PATENT DOCUMENTS

EP 3539402 A1 * 9/2019 ..... A42B 3/124
EP 3422887 B1 * 11/2020 ..... A42B 3/064

OTHER PUBLICATIONS

European search report and opinion dated Jun. 4, 2020 for received for EP application n. EP19020703.

* cited by examiner

-prior art-

-prior art-

HELMET

TECHNICAL FIELD

The present invention relates to a helmet for sport activities for safeguarding the head against impacts.

BACKGROUND ART

In the state of the art several types of helmets exist: motorcycle helmets, automotive race helmets, industrial safety helmets, hard-hats, bike helmets, ski helmets, water-sports helmets, equestrian helmets, American football helmets, etc.

The present invention relates mainly to helmets for sporting activities but it's not limited to them.

Traditional helmets comprise:

- a thin shell or an external cover;
- a protective padding matching with the shell and arranged into the shell;
- a comfort padding for making the helmet much comfortable when it's worn by the user;
- a retention system, generally comprising a strap and a quick-release locking system.

Said shell gives to the helmet a specific appearance and allows to protect and contain the protective padding. The material of the shell can be a polymer such as PC (polycarbonate), PE (polyethylene), ABS (acrylonitrile butadiene styrene) or a composite material such as glassfibre or carbon fibre. Depending on the material, the shell is generally thermomoulded or thermo-formed, for example in bike helmets, or injection-moulded, for example in sky helmets.

The protective padding is made of polymeric foam, generally EPS (Expanded Polystyrene) or EPP (Expanded Polypropylene), and is used for absorbing the energy generated during a collision. The EPS pad or layer absorbs the energy from an impact through compression. In bike helmets, since the shell layer is very thin like a skin, it assumes the shape of the EPS layer. In general, the appearance of the sport helmet depends on the shape of EPS layer.

The comfort padding can comprise pillows made of synthetic or natural material, which adhere to the internal side of the protective padding. In this way, the head of the user is not in direct contact with the protective padding but with the comfort padding that is much comfortable.

The retention system is used for maintaining the helmet in position on the head of the user and can comprise a regulation device for regulating the tightening of the helmet on the head.

Helmets for sport are considered by users like sportswear and for this reason the external shape of these helmets changes quite often because of current fashion. Consequently, a sport helmet needs to be redesigned regularly. Redesigning a helmet implies that external and consequently internal architectures change.

Actually, the EPS is the most used material for absorbing the energy from an impact and it is used by the large part of helmets. The performance of EPS is reduced from variations in temperature and humidity. For example, in hot temperature the EPS becomes soft and in cold temperatures it becomes hard and brittle. Consequently, the validity period of a protecting padding is generally not more than 5 years. For this reason, certain helmet manufacturers suggest replacing the helmet after a predetermined period of time. Furthermore, the overall dimension and shape of actual sport helmets strictly depend on the thickness of the protective padding. Helmet performance can only be improved by increasing the thickness or changing the EPS specification.

In the state of the art are also known improved helmets that substitute part of the energy absorbing function of EPS with other kinds of impact absorbing structures, like the solutions disclosed in the documents EP3422887 and DE29917109. Example in this sense are the helmets comprising energy absorbing pads, like that distributed with brand Koroyd®. This kind of helmet 100 comprises an external shell 104 made of PC, PE or ABS, under which a layer made of EPS 101 is arranged. Below the EPS layer 101 one or more of energy absorbing pads 102 are arranged, as shown in FIG. 1A, in order to form the protective padding.

KOROYD® is an energy absorbing structure consisting of cylindrical polymeric cells joined each other along their sides so to realize a compact and resistant energy absorbing pad, as patent EP1694152B1 describes.

Other similar energy absorbing pads are known in the art, for example the honeycomb cells of patent application EP3422887A1.

The EPS layer of this type of helmets comprises recesses wherein energy absorbing pads, like that named Koroyd®, are partially housed. Differently from the traditional sport helmet wherein the protective function is provided by the EPS layer, in this type of helmet, the impacts are absorbed by both EPS layer and energy absorbing pads. This construction offers helmet designers the opportunity to alter many more variables in the helmet design to further optimise the helmet's performance.

The EPS layer 101 of this kind of helmet has a very complex shape, as shown in FIG. 1, and comprises a lot of cavities 106. Each cavity 106 has a predetermined shape so to admit an energy absorbing pad 102 or to allow the passage of air. In the portions of the EPS layer 101 not having cavities 106, the thickness is higher. Normally, in this kind of helmet 100, the energy absorbing pads 102 are almost entirely contained in the EPS layer 101.

With reference to FIG. 1B, the EPS layer 101 with these cavities 106 is normally realized by moulding. In order to realize these internal cavities 106, the positive mould portion 120 can comprise tens of detachable inserts 130 that needs to be connected each other before assembling the mould and placing the polystyrene beads into the mould. The same applies also to the negative mould portion 110, that is realized with many other pieces. Once the polystyrene beads are expanded into the mould and the layer 101 is solidified, the negative mould portion 110 is detached and disassembled, while the positive mould portion 120 must be dismounted piece by piece in order to extract the positive mould 120 from the EPS layer without damaging the latter. This activity is very complicated and very time-consuming. Moreover, if the helmet sizes are several, for example small/medium/large, moulds are more than one and the manufacturing complexity increases. None of the known solution solved the problem of providing an alternative to this very complicated way of realizing the EPS layer for these types of sport helmets.

Furthermore, the thickness T3 of the protective padding is comprised in a predetermined range in sport helmets, which normally can vary between 18 mm and 30 mm. Since energy absorbing pad 102 has normally better performances in term of energy impact absorption with respect to EPS layer 101, better absorbing performances of the helmet would be obtainable by augmenting the thickness T2 of energy absorbing pad 102 to the detriment of EPS layer 101 thickness T1. For example, energy absorbing pad 102 named KOROYDR has a behaviour similar to a solid after a compression of 85% of its thickness, while EPS has a behaviour similar to a solid after a compression of 65% of its thickness, consequently a protective padding 105 made entirely by KOROYD® material would be ideal, but this solution is not possible because an energy absorbing pad 102 needs to be contained by a structure which provides to the helmet the external appearance and allows the connection of retaining straps. Moreover, a minimum thickness T1 of the EPS layer must be guaranteed in order to allow to the beads of polystyrene to fill completely the mould before their expansion and to avoid rupture of the EPS layer 101 during helmet production. Additionally, the external shape of the helmet needs to be changed often for following fashion evolutions. This is the reason why the EPS is still today the only affordable solution to all above mentioned problems and the average thickness of the EPS layer is never less than 10 mm in correspondence of the energy absorbing pads. Consequently, sport helmets are less effective than they could be.

Furthermore, if a helmet comprises several apertures for facilitating airflow, the helmet structure becomes fragile and needs to be reinforced to prevent ruptures during an impact. Normally, in order to achieve this reinforcement, the density of the EPS is increased or a roll cage or a frame is co-moulded with EPS, but these reinforcement techniques reduce the performance of a helmet in case of an impact.

Moreover, in the state of the art solutions wherein at least a part the helmet is made by 3D printing, like the solutions of US2019/231018 and EP3130243, are known.

Other helmets are present in the state of the art, but none of them solve all the following problems with its architecture:

- allowing an efficient ventilation of the head of a user wearing the helmet;
- improving the absorption of impact with respect to helmets comprising EPS protective padding or with respect to helmets entirely made by additive manufacturing;
- facilitating the manufacturing and the assembly of the helmet;
- reducing costs and complexity of production with respect to helmets entirely made through additive manufacturing;
- allowing a simple personalization of the helmet;
- allowing to adapt a single helmet to different scopes and sport activities;
- improving the penetration resistance to spike or pointed elements.

Helmets known in the art favour one or two of the above-mentioned advantages but never all of them.

SUMMARY

Said inconvenience of the state of the art are now solved by a helmet, particularly suitable for sport activities, comprising a first protective collapsible portion, a second protective collapsible portion, and at least one energy absorbing pad permeable to air arranged in-between said first and second protective collapsible portions. The first and second protective collapsible portions are directly coupled to each other through one or more mechanical couplings. Preferably, the first and second protective collapsible portions are shaped so to mate to each other. The term "collapsible portion" means a crushable element of a helmet capable of absorbing energy converting the kinetic energy of a compressive load into a compressive deformation of its body that renders it more compact and small. This solution allows to simplify the geometry of pieces composing the helmet and to extremely simplify its assembling. Furthermore, the helmet so conceived is compact like a traditional helmet and capable of absorbing by deformation a large amount of impact energy. Moreover, being the first protective collapsible portion, the second protective collapsible portion and the energy absorbing pad discrete elements, the maintenance and cleaning of this kind of helmet is greatly improved and simplified. Preferably, the first protective collapsible portion is arranged over the second protective collapsible portion, in this way an easy customization of the helmet appearance is also obtainable.

In particular, the first and second protective collapsible portions are configured to fit each other, in order to allow small relative movements of these two portions constituting the skeleton of the helmet. Moreover, this fitting allows to avoid undesired separations of the two protective collapsible portions.

One of first and second protective collapsible portions incorporates one or more protuberances/male elements that are configured to engage respective one or more recesses/female elements incorporated in the other one of first and second protective collapsible portions. Said male and female couplings realize said mechanical couplings. In this way a fine positioning of the two portions one over the other is achievable and a decoupling is avoided/limited.

Advantageously, the first and/or second protective collapsible portions can comprise at least one pocket for accommodating said at least one energy absorbing pad. In this way, the positioning of the energy absorbing pad is simplified.

The first and/or second protective collapsible portions can be made of a closed-cell polymeric foam, like EPS or EPP. Combining the present helmet arrangement with EPS or EPP, a synergic effect is obtainable because inner undercuts of EPS/EPP items are drastically reduced and consequently these items become easier to be moulded and consequently cheaper with respect to actual known solutions.

Alternatively, the first and/or second protective collapsible portions can have a lattice structure, preferably obtained through additive manufacturing, which allows to have a lighter and more breathable helmet with respect to conventional or said improved helmets. Furthermore, dividing the external portion in two protective collapsible portions, the production of these elements via additive manufacturing is simplified.

When the protective collapsible portions are made of a closed-cell polymeric foam or a lattice structure, the helmet is lighter with respect to the traditional helmets having a shell, without affecting the security.

The at least one energy absorbing pad is preferably enclosed between the first and second protective collapsible portions so to remain in the helmet. The term "enclosed" means that the at least one energy absorbing pad is totally surrounded by the first and second protective collapsible portions. In particular, the second protective collapsible portion is shaped so to prevent the extraction of the at least one energy absorbing pad from the helmet when it is arranged in-between first and second protective collapsible portions. In this way, the energy absorbing pad can't be removed from the helmet even in case of an impact.

The energy absorbing pad remains always lodged in the helmet and any leakage is prevented.

Advantageously, at least a portion of the first protective collapsible portion is protected by a shell connected to said first protective collapsible portion. This feature allows to spread more efficiently the load of an impact on a wider portion of the first protective collapsible portion reducing the concentration of stresses in the helmet.

Preferably the helmet comprises first and second protective collapsible portions having one or more vents for admitting air into the helmet and improving the ventilation of user head.

Each energy absorbing pad can comprise a plurality of cells connected each other to form an array of energy absorbing cells. This structure demonstrates an improved resistance to impacts. Preferably said adjacent cells are thermally welded, glued or bonded to each other on a portion of their lateral surfaces in order to reduce cells bending and to favour cells axial collapsing. More preferably, the longitudinal axis of each cell of said plurality of cells is substantially radially oriented with respect to a geometrical center of the helmet. This array of energy absorbing cells substantially corresponds to a honeycomb sheet.

The plurality of cells of the energy absorbing pad are tube-shaped, hexagonally-shaped, non-hexagonally-shaped, or are arranged so to form an open-cell structure. In general, this kind of structure belongs to the known family of cellular materials.

The second protective collapsible portion can be dome-shaped and the first protective collapsible portion can have an inner portion shaped so to mate with the second protective collapsible portion. In this way, a spherical coupling is achieved, which allows to the second protective collapsible portion to rotate with respect to the first protective collapsible portion, in all angular direction, for reducing risk of injury to the brain mass.

In general, the energy absorbing pad is configured and structured so to absorb more energy of an impact than the first and/or second protection portions. Its structure allows it to absorb a large quantity of energy in case of an impact by deformation, in particular plastic deformation. In this way, the helmet has an inner core capable of absorbing more energy than the external and more aesthetica) components.

Further inconvenients are solved by the technical characteristic and details provided in the dependent claims of the present invention.

These and other advantages will be better understood thanks to the following description of different embodiments of said invention given as non-limitative examples thereof, making reference to the annexed drawings.

DRAWINGS DESCRIPTION

DETAILED DESCRIPTION

The following description of one or more embodiments of the invention is referred to the annexed drawings. The same reference numbers indicate equal or similar parts. The object of the protection is defined by the annexed claims. Technical details, structures or characteristics of the solutions herebelow described can be combined with each other in any suitable way.

Figure 2:
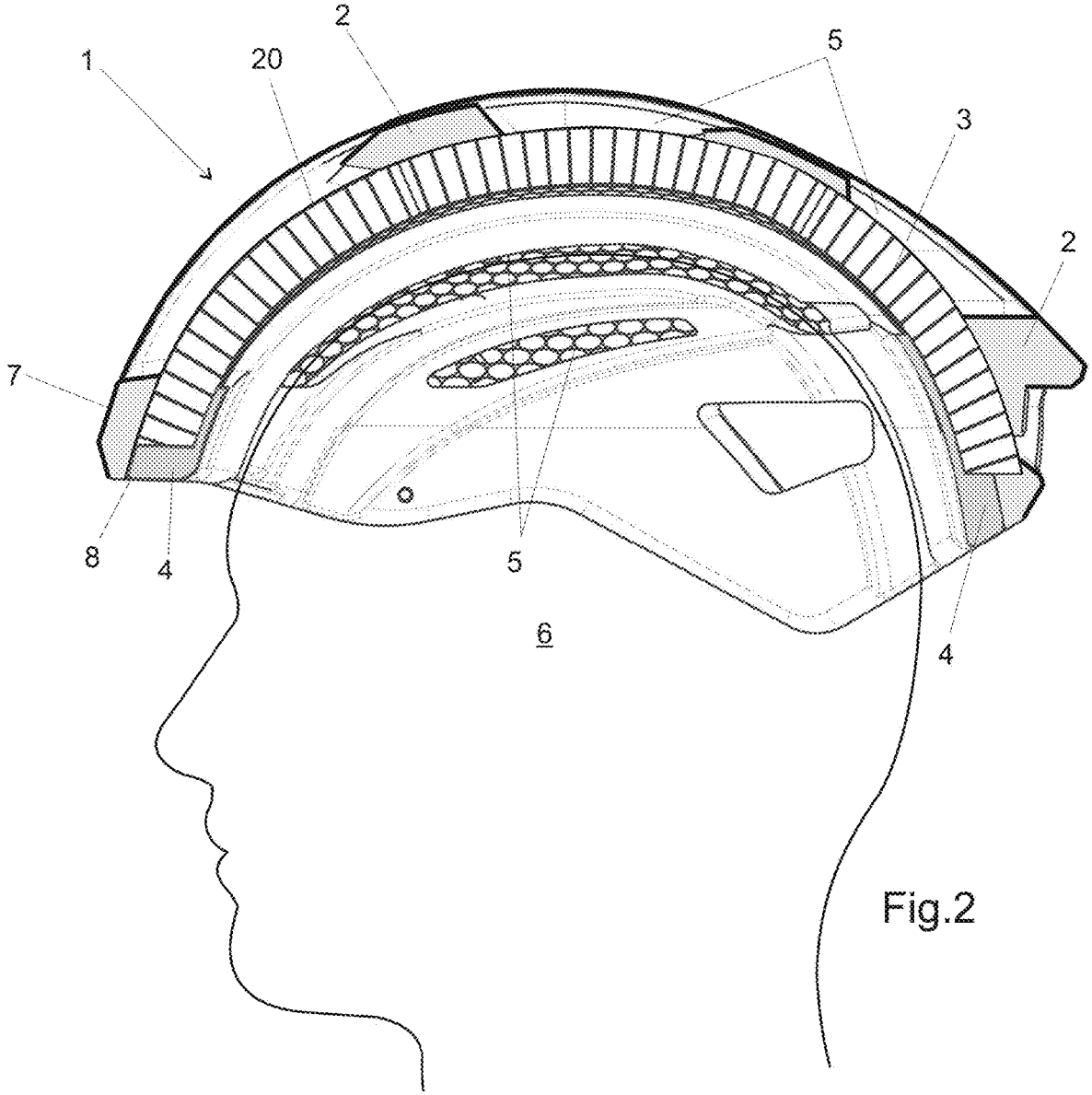
FIG. 2 shows a cross-section of a helmet according to a first embodiment of the present invention.

With reference to the FIG. 2 is illustrated an helmet 1 for bike which comprises three main elements.

A first protective collapsible portion 2 arranged externally, a second protective collapsible portion 4 arranged below the first one, and one energy absorbing pad 3 that is positioned among the first and second protective collapsible portions 2,4.

The energy absorbing pad 3 is configured for being permeable to air.

The first and second protective collapsible portions 2,4 are almost shaped like slices of a traditional helmet's protective pad that has been cut in two along a curved-plane parallel to the surface of the helmet wherein the user's head can be positioned.

The first protective collapsible portion 2, which corresponds to the upper part of the helmet 1 can optionally comprise a shell 7 to protect the underlying components of the helmet.

If the first protective collapsible portion 2 is made of a closed-cell polymeric foam, like EPS or EPP, the shell 7 protects the below portions, that are more fragile and softer, from deformations and degradation.

If the first protective collapsible portion 2 is a lattice structure, or a cellular structure, the shell 7 is used to spread the load impact on a wider area of the lattice structure.

The shell 7 is made of a polymeric material like polycarbonate, polyethylene, or acrylonitrile butadiene styrene, but other materials can be employed.

First and second protective collapsible portions 2,4 comprise a plurality of vents 5 for cooling the head of sportsman wearing the helmet 1.

When the first and/or second protective collapsible portions are made of a mouldable closed-cell polymeric foam-like EPS or EPP, the first portion 2 and second portion 4 are shaped so to minimize the undercuts which are difficult to be realized when said portions are molded. For example in the embodiment of FIG. 2, almost no inner undercuts are present in the first and second protective collapsible portions 2,4, despite of this the helmet 1 has vents 5 and a pocket 8 for receiving the energy absorbing pad 3.

In the known helmets, the contemporary existence of a pocket 8 for the energy absorbing pad 3 and vents 5 is not possible without having undercuts; this implies that helmets using traditional EPS/EPP protective pads are not easy to be realized and their molds have very complicated shapes with a lot of pieces, as already explained in the background chapter. On the contrary, dividing the protective collapsible portion in two pieces/layers, as in the present invention, the undercuts are reduced or even eliminated and the molding process of these portions becomes easy and cheap.

Figure 4A:
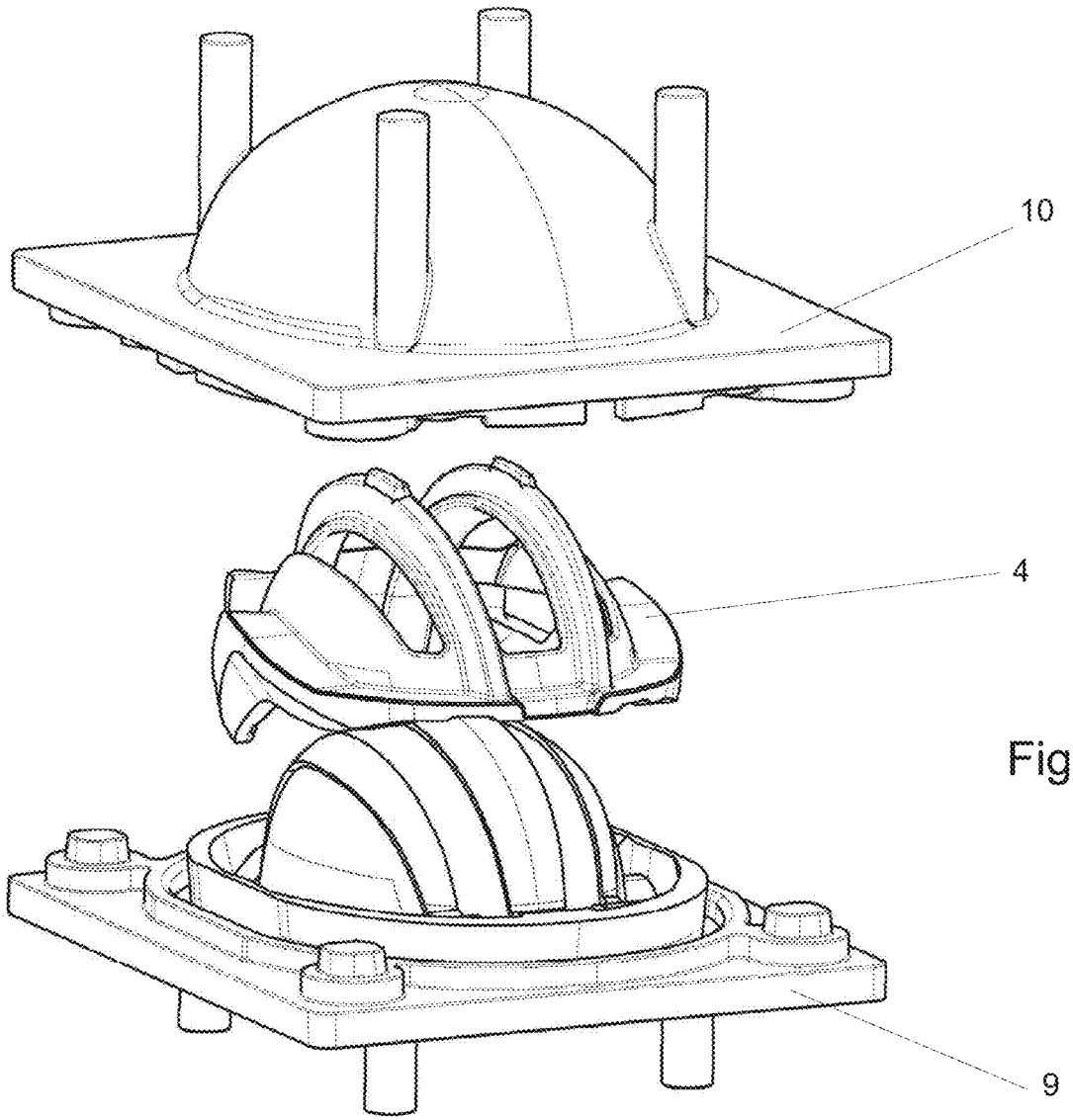
FIG. 4A shows an exploded view of a mould for realizing the second protective collapsible portion of a helmet according to the present invention.
Figure 4B:
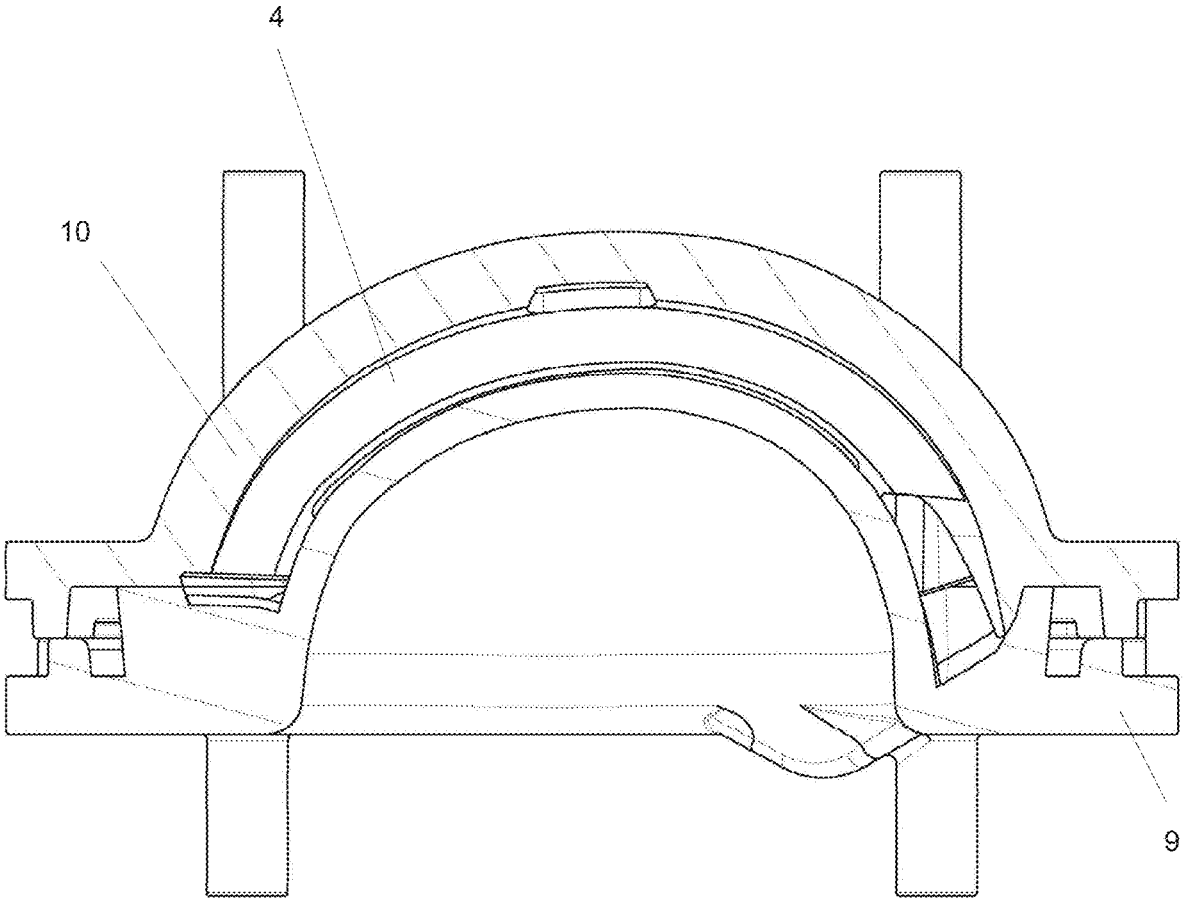
FIG. 4B shows a cross-section of the mould and second protective collapsible portion of FIG. 4A.

In particular, with reference to FIG. 4A the second protective collapsible portion 4 comprises vents and a pocket, which is realized by means of a positive mould 9 and a negative mould 10 made in one single piece, without inserts to be assembled before molding. FIG. 4A shows the same elements of FIG. 4B disassembled, wherein the second protective collapsible portion 4 is separated from its negative and positive molds 10, 9, which are made in a single piece. Since the mould is simplified, the manufacturing of this kind of helmet is easy, quick, cheap and does not require a molder having particular skills.

The first protective collapsible portion 2 is generally arranged over the second protective collapsible portion 4 in order to have a separation surface with a longitudinal development. The separation surface is the imaginary surface of contact between first and second protective collapsible portions 2,4.

Being the first and second protective collapsible portions 2,4 separated according to an up-down direction, the portions can be colored differently and the helmet can be customized very easily. For example the lower second protective collapsible portion 4 can be always gray, while the upper first protective collapsible portion 2 can be colored with different colors, so to allow a personalization of the helmet by simply choosing the preferred upper portion 2.

Furthermore, the first protective collapsible portion 2 can be configured so to have different mechanical or aerodynamic properties. In this way, a mountain biker can choose a first protective collapsible portion styled for cross country riding which offers a greater coverage and more protection from penetration from tree branches and other sharp items, while a road cyclist can choose a first protective collapsible portion which is slimmer, more aerodynamic, lightweight and suited to the latest performance road cycling aesthetic. Similarly, a city biker can choose a more stylish upper lattice portion which is also more breathable and with greater durability for everyday use.

In a particular embodiment (not shown), the first and second protective collapsible portions are arranged according to a left-right direction, thus divided according to a vertical-longitudinal plane.

In a further special embodiment (not shown), the first and second protective collapsible portions are arranged according to a front-rear direction, thus divided according to a vertical-transversal plane.

In another embodiment (not shown) the protective collapsible portions are more than two in order to further simplify the realization and assembly of the helmet.

The first and second protective collapsible portions 2,4 are configured to fit each other.

The first and second protective collapsible portions 2,4 are complementary so to facilitate the reciprocal positioning.

Figure 6:
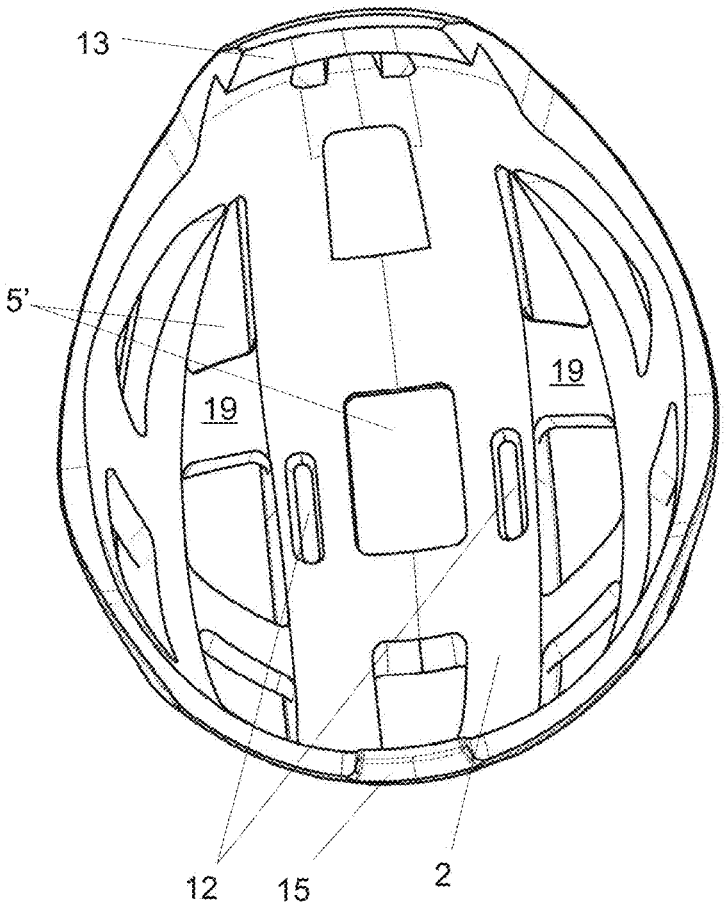
FIG. 6 shows the helmet of FIG. 5 partially disassembled so that its inner arrangement can be seen.
Figure 6:
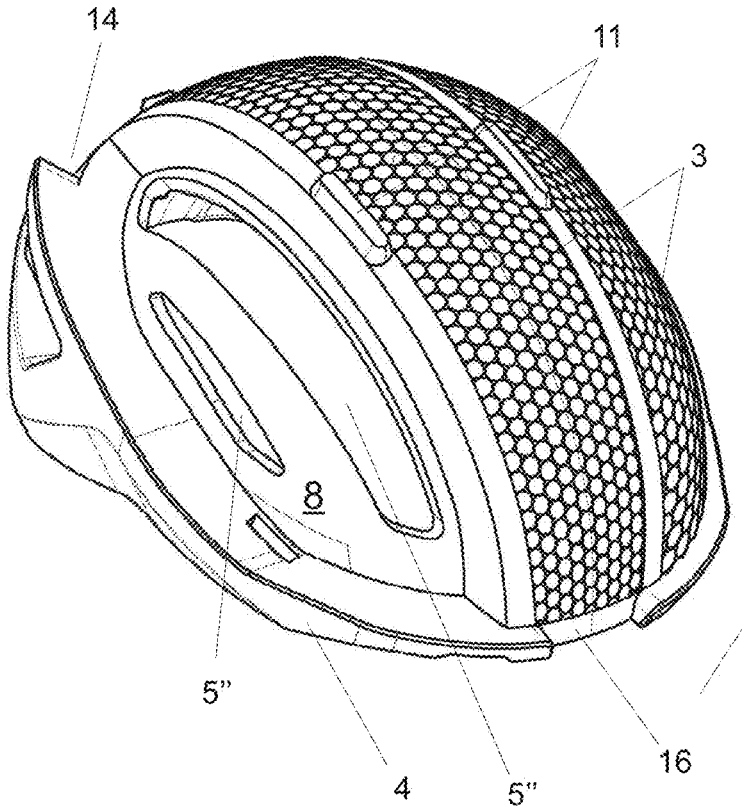

Furthermore, as shown in FIG. 6,7, the below second protective collapsible portion 4 comprises two vertical pin elements 11 (male elements) configured to fit with two recesses 12 (female elements) arranged in the upper first protective collapsible portion 2. The coupling of each pin element 11 with the corresponding recess 12 allows to avoid or minimize lateral displacements of the first protective collapsible portion 2 with respect to the second protective collapsible portion 4. This protuberance/male element 11 and the corresponding recess/female element 12 represents a first mechanical coupling.

The embodiment represented in FIG. 6,7, also includes a further pin 15 arranged in the front of the first protective collapsible portion 1. When the first protective collapsible portion 2 overlaps the second protective collapsible portion 4, this further pin 15 engages a recess 16 arranged in the front part of the second protective collapsible portion 4. This further pin 15 allows to limit or prevent backwards movements of first protective collapsible portion 2 with respect to the second protective collapsible portion 4. This coupling between the further pin 15 and the corresponding recess 16 provides a second mechanical coupling.

As shown in FIG. 6,7, the rear part of first protective collapsible portion 2 comprises a tooth 13 that is configured to fit with a complementary recess 14 arranged in the rear part of the second protective portion 14. In this way, the first protective collapsible portion 2 mates with the second protective collapsible portion 4, limiting/preventing the upwards and frontwards movements of the first protective collapsible portion 2 with respect to the second protective collapsible portion 4. Even in this case, the tooth 13 and the recess 14 represent a third mechanical coupling between the first and second protective collapsible portions 2,4.

These series of pins/teeth 11,15 and recesses/cavities 12, 16 correspond to said mechanical couplings of the first protective collapsible portion 2 with the second protective collapsible portion 4.

The mechanical couplings between first and second protective collapsible portions 2,4 are realized through male and female elements belonging to first and second protective collapsible portions 2,4 respectively, or vice versa.

Substantially, elements respectively belonging to the first and second protective collapsible portions are shaped so to be complementary. Each of these couplings prevent or limit at least one relative degree of freedom of said collapsible portions 2,4.

Once the first and second protective collapsible portions 2,4 are clamped/stuck each other, the energy absorbing pad 3 cannot be extracted without separating first and second protective collapsible portions 2,4 from one another.

The mechanical couplings prevent or limit a disconnection of the first and second protective collapsible portions and permit small relative movements.

Being the first and second collapsible portions mechanically couplable/decouplable in a quick and easy manner, the personalization in terms of mechanical and aesthetica) characteristics is simplified and even the inner energy absorbing pad/s can be customized.

Further connecting means can connect the first and second protective collapsible portions 2,4 together avoiding their disconnection. Examples of these connecting means can be a screw (not shown) passing through the first protective collapsible portion 2 and screwed on the second protective collapsible portion 4 or vice versa. Alternatively, these connecting means can be one or more elastic rings engaged to hooks (not shown) arranged respectively on the outer sides of the first and second protective collapsible portions 2, 4, for avoiding a removal of the upper portion 2 from the lower portion 4. These hooks can be arranged laterally, on the back or in the front. These connecting means can also be reduced or completely eliminated through the use of adhesives.

One or more energy absorbing pads 3 are arranged between said first and second protective collapsible portions 2,4 and are accommodated in specific pockets 8 created in the first and/or second protective collapsible portions 2,4.

Figure 3:
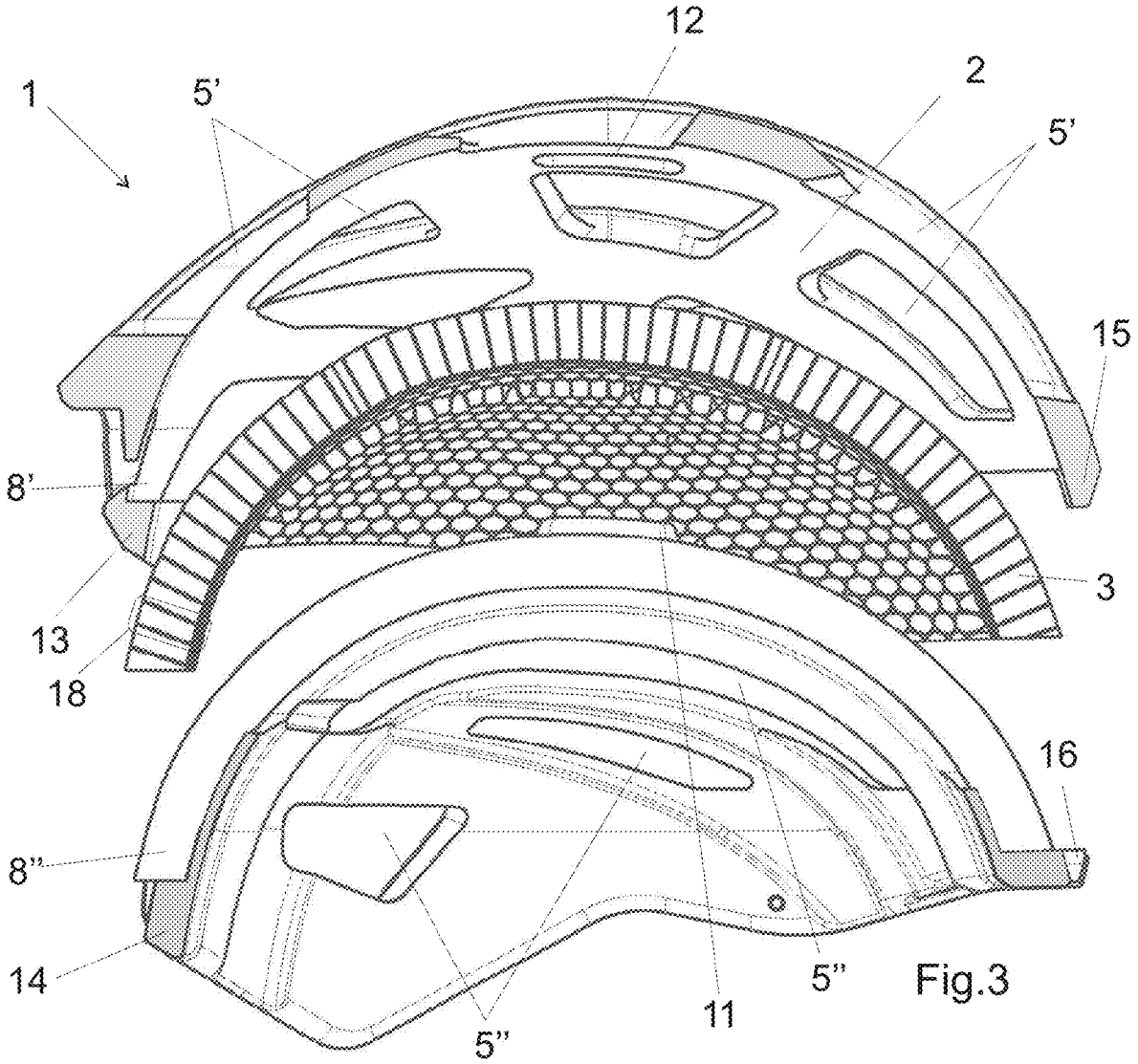
FIG. 3 shows an exploded view of the helmet of FIG. 2.

In the embodiment of FIG. 2-3 the energy absorbing pad 3 is only one and is partially accommodated in a hemi-pocket 8' realized in the first protective collapsible portion 2 and partially in a further hemi-pocket 8" realized in the second protective collapsible portion 4.

In the embodiment of FIG. 6,7, three energy absorbing pads 3 are positioned in respective pockets 8" of the second protective collapsible portion 4.

Once the first and second protective collapsible portions 2,4 mate to each other, this at least one pocket 8 entraps the at least one energy absorbing pad 3, and consequently it cannot escape from the helmet 1.

Despite the at least one energy absorbing pad 3 is entrapped between the first and second protective collapsible portions 2,4, it can preferably slip with respect to the first protective collapsible portion 2 over a low friction layer/coating 20 arranged on the inner side of the first protective collapsible portion 2, allowing to reduce brain injuries due to the rotation of brain mass.

The low friction layer/coating 20 is arranged between the first protective collapsible portion 2 and the energy absorbing pad 3 so to allow a relative slide between them. Preferably, the low friction layer/coating 20 is breathable.

The low friction layer 20 is made of a low frictional material like PTFE, polycarbonate, nylon or any material defining a coefficient of friction less than 0.5. Alternatively, it can be a visco-elastic material, which is also able to absorb energy from the relative movement of the different helmet components.

Figure 8:
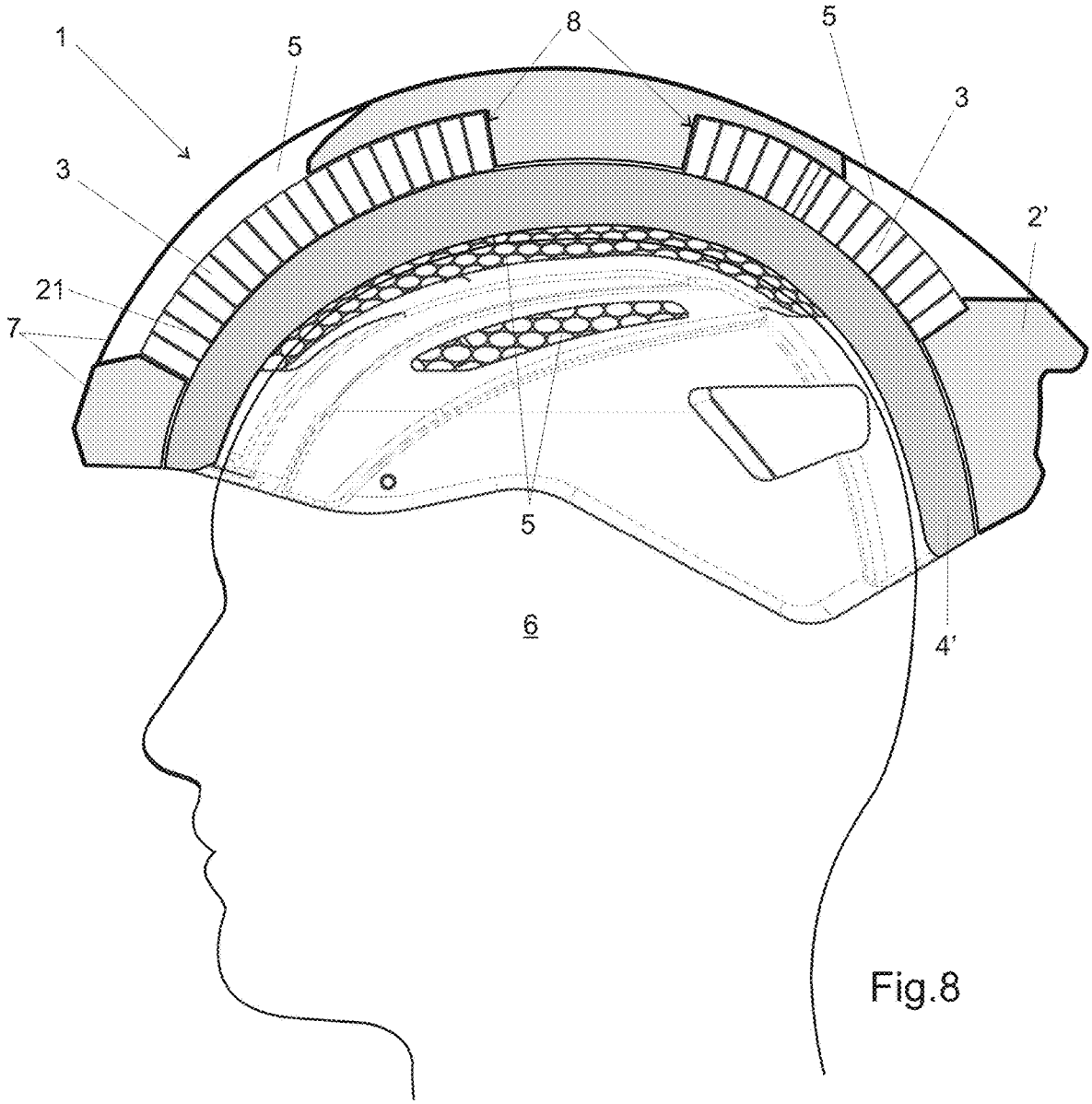
FIG. 8 shows a third embodiment of a helmet according to the present invention.

In a further embodiment, shown in FIG. 8, the second protective collapsible portion 4' is shaped like a dome, thus having an external side shaped substantially like a sphere. In this embodiment, the inner face of first protective collapsible portion 2' has a portion that is complementary to that of said dome second protective collapsible portion 4'. Also the energy absorbing pad 3 has an inner side shaped in complementary way to that of the external side of said dome-shaped second protective collapsible portion 4'.

In this specific embodiment a layer 21 of low friction or visco-elastic material is arranged on the outer side of the dome-shaped second protective collapsible portion 4'. Due to this specific shape of the second protective collapsible portion 4', it can rotate into the first protective collapsible portion 2' and into the energy absorbing pad 3, like the ball of a ball-joint coupling.

This specific arrangement allows to minimize the risk of rotation of the brain mass. Eventual end-of-stroke means can be provided to limit the stroke of second protective collapsible portion 4' with respect to the first protective collapsible portion 2'.

In a further embodiment represented (not shown), the helmet 1 comprises a first protective collapsible portion 2 connected to the second protective collapsible portion 4 via a plurality of flexible elements. Each flexible element has one end connected to the first protective collapsible portion 2 and the opposite end connected to the second protective collapsible portion 4. The flexible element can be an elastic element, for example made of rubber or another elastomeric material. The ends of the flexible elements can be shaped to snap-fit into specific holes or cavities of the first and second protective collapsible portion 2,4. In this way, the first protective collapsible portion 2 can slide over the second protective collapsible portion 4, creating a small degreed of freedom that reduces torque to brain mass during an impact.

In the embodiment of FIGS. 2,3,5 and 6, the first and second protective collapsible portions 2,4 are made of a closed-cell polymeric foam like EPS.

As already described, when the first and/or second protective collapsible portions 2,4 are made of a closed-cell polymeric foam EPS or EPP, their production is simplified.

Normally sport helmets have a very complex shape and consequently the manufacturing of EPS/EPP portions is very complicated. Spreading this complexity on more pieces allows to have pieces with a more simple shape. For example, undercuts can be avoided or minimized. In this way, the overall shapes of first and second protective collapsible portions 2,4 can remain complex, like that of FIGS. 2,3,5 and 6, but without a complicated moulds and excessive time and costs of production.

Figure 7:
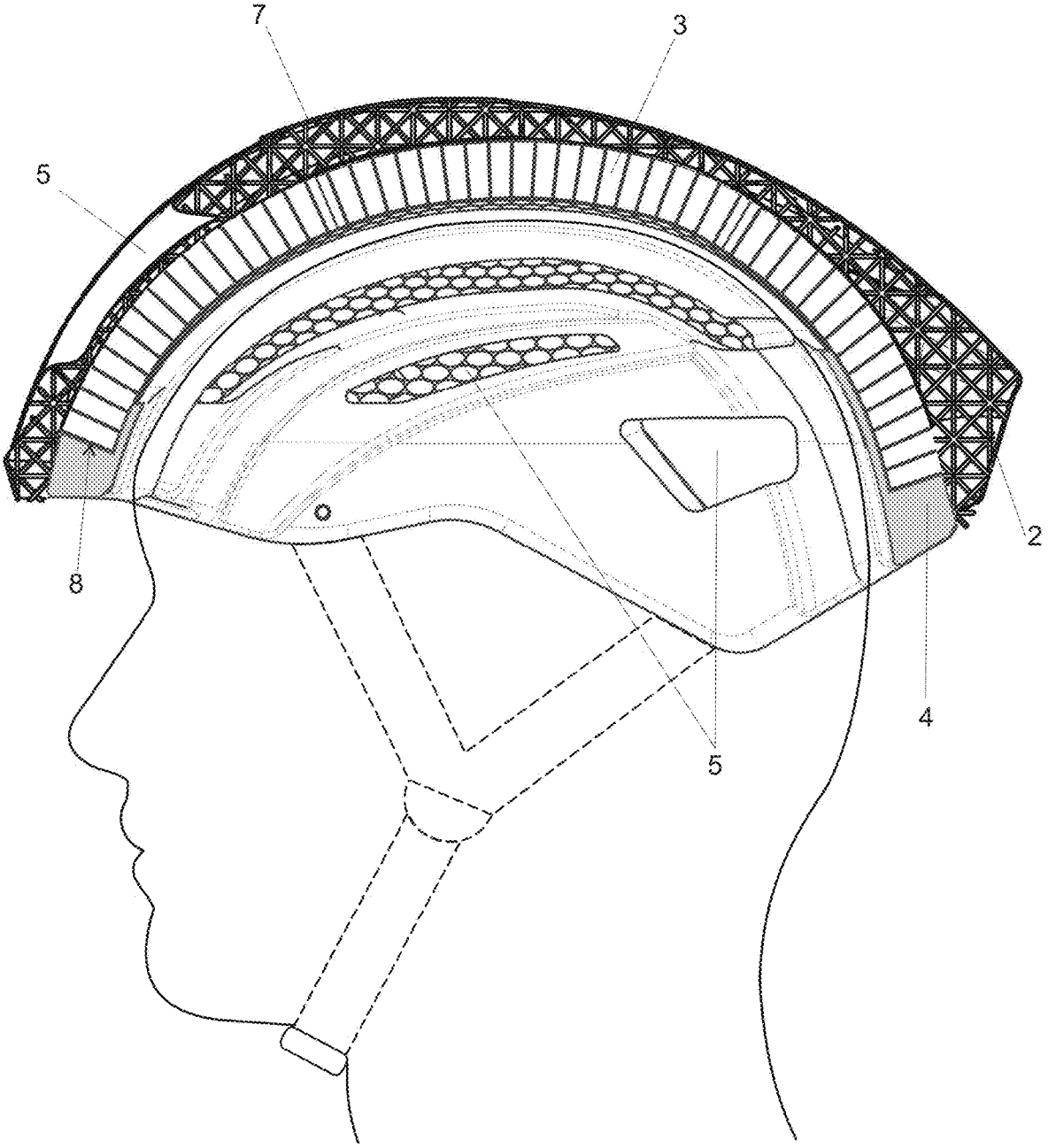
FIG. 7 shows a second embodiment of a helmet according to the present invention.

Alternatively, the first and/or second protective collapsible portions 2,4 can have a lattice structure, as shown in FIG. 7.

In FIG. 7 is shown a helmet having an upper first protective collapsible portion 2 having a lattice structure 17, thus a structure having beams interconnected each other according to a predefined rule so to create a three-dimensional grid capable of absorbing and contemporary spreading an impact load on the underlying energy absorbing pad 3. The lattice structure 17 of first protective collapsible portion 2 is also more breathable with respect to an equivalent EPS/EPP portion. Indeed, the air coming from outside the helmet 1 can enter through outer vents 5 or apertures of the helmet 1 and circulates freely into the lattice structure 17 up to the user head, which is thus completely ventilated.

The first protective collapsible portion made with lattice structure 17 of FIG. 7 can also comprise a shell 7 that is holed in correspondence of vents 5.

In this embodiment, the second protective collapsible portion 4 is made of a closed-cell polymeric foam like EPS, or alternatively EPP, in order to make the helmet 1 much comfortable.

The foam second protective collapsible portion 4 comprises a pocket 8 configured to admit the energy absorbing pad 3.

In the helmet of this embodiment, the second protective collapsible portion 4 also comprises longitudinal air channels 19 that are realized through recessed/embossed portions of the inner side of second protective collapsible portion 4.

In an alternative embodiment (not shown), the first protective collapsible portion is made of a closed-cell polymeric foam, like EPS/EPP, while the second protective collapsible portion has a lattice structure.

In a further alternative embodiment, both first and second protective collapsible portions are lattice.

Both first and/or second protective collapsible portions 2,4 can have a lattice structure, thus a three-dimensional grid of full portions, also called rods or beam, which define empty portions.

The empty portions are interconnected each other so to create a network of empty spaces wherein the air can flow. The full portions are organized and distributed according to a predetermined law of distribution. Lattice structure is preferably organized in elementary unit cells that are all equal and repeated in the same way according to vertical and horizontal directions.

The elementary unit cell can be shaped as one of the following type: diamond face-centered cubic (DFCC), diamond hexagonal (DHEX), body-centered cubic (BCC), face-centered cubic (FCC) or 3D Kagome. Other arrangement of the rods of the lattices structure can be used like gyroids or open cell structures. In particular, the lattice structures wherein the full portions bend if the lattice structure is compressed along a radial direction are preferred.

The material of the lattice structure can preferably be an elastomeric polymer, for example a thermoplastic polyurethane (TPU) when multiple impacts need to be absorbed, like in case of skateboard helmet. Since the TPU is reversible, the helmet maintains its shape and behaviour even after an impact. Alternatively, the material of lattice structure can be a non-elastomeric polymer, for example polyamide (PA) when a higher quantity of energy needs to be absorbed, like in bike helmets. In this case, the full portions undergo to a plastic deformation absorbing a large quantity of energy. In this case, the lattice structure involved in the impact is irreversibly sacrificed.

The lattice structure is manufactured by additive manufacturing, also known as 3D printing. Preferably the lattice structure is manufactured by layer-by-layer manufacturing technologies.

Each energy absorbing pad 3 has an outer curved surface and an inner curved surface configured so to match respectively with at least a part of the inner surface of the first protective collapsible portion 2 and outer surface of the second protective collapsible portion 4, preferably in correspondence of said pocket 8.

Said energy absorbing pad 3 is preferably of a permeable type.

The permeable energy absorbing pad 3 is configured so to allow the transit of airflow across its body, allowing an exchange of air between first and second protective collapsible portions 2,4.

Each energy absorbing pad 3 comprises a plurality of cells 18 connected each other to form an array of energy absorbing cells. The energy absorbing pad 3 has a structure that allows the transit of airflow through it.

As shown in FIG. 3, the energy absorbing pad 3 can be configured like that of patent EP1694152B1, that is herein incorporated by reference as regards the cells arrangement and energy absorbing pad construction.

In this type of energy absorbing pad 3, the air coming from outside flows through the cylindrical cells of the energy absorbing pad and reaches the wearer's head.

The energy absorbing pad 3 comprises a plurality of short cylindrical tubes, representing its cells 18, connected each other along their sides so to form a honeycomb sheet.

The honeycomb panel is obtained bonding lateral surfaces of adjacent cells 18 to each other. The bonding is realized through heating the cells 18 until they partially fuse together or by gluing or welding them together. Alternatively, the bonding is realized through an adhesive layer arranged between neighbouring tubular cells.

The honeycomb panel so obtained is flat and all longitudinal axes of these cells 18 are all parallel each other. Subsequently, the sheet is thermoformed on a curved surface like a standard headform, so to bend the sheet and to form the energy absorbing pad 3 having its curved shape.

Alternatively, the honeycomb panel can be auxetic so to conform more easily to a headform without any thermoforming. Thanks to its double curvature, an auxetic geometry contracts in-plane when it is subjected to out-of-plane compression, providing a sort of inherent local reinforcement. After the bending activity of the panel, the axes of the cells 18 become oriented according to a radial direction and are no more parallel each other. These cells 18 are substantially radially oriented with respect to a geometrical center of the inner empty space 6 of the helmet 1 that is configured for receiving the wearer's head. This orientation of the cells 18 allows to efficiently absorb impact coming radially on the external surface of the pad 3. When the first protective collapsible portion 2 receives an impact the load is partially absorbed by the collapsing of first protective collapsible portion 2 body, both in case of closed-cell polymeric foam or lattice arrangement. The same collapsing occurs in the second protective collapsible portion 4. These collapses occur when the closed-cells of the foam or the elementary cells of the lattice structure subside on each other under a compressive load. The first protective collapsible portion 2 spreads the impact load on a wide area of the underlying energy absorbing pad 3. The energy absorbing pad 3 thus receives the energy from the impact according to normal directions to its external surface and consequently the cells 18 tend to be compressed along their longitudinal axes. The rest of the energy of the impact is then absorbed by the second underlying collapsible portion 4.

The compressed cells 18 would bend laterally, but since they are connected each other, the only deformation admitted for them is to crush, collapsing along their longitudinal axes. In this way a maximum energy absorption is obtained. The same applies if the cells 18 of energy absorbing pad 3 are structured like tubes having hexagonal or non-hexagonal cross-sections (not shown).

The energy absorbing pad is characterized by its ability to absorb more energy through deformation with respect to the first and/or second protective collapsible portions 2, 4. Moreover, the first protective collapsible portion 2 can be configured to absorb more or less energy with respect to the second protective collapsible portion 4, as a function of the use it might be.

The airflow passes through the tubular cells 18 from their outermost edges towards their innermost edges. In these cases, repetitive discrete cells are recognizable in the energy absorbing pad 3.

Alternatively, the energy absorbing pad 3 is formed by an open-cell foam (not shown) wherein the large part of cells are connected each other so to realize a network of interconnected air channels which allows the transit of air across the pad's body.

In all these cases, the energy absorbing pad 3, in addition to provide an energy absorbing function, allows the transit of air, contributing to a more efficient ventilation of the entire user head.

Cells 18 of energy absorbing pad 3 are preferably made of polycarbonate, polyester or polypropylene and absorb compression load by plastic deformation.

The sheet from which the pad 3 is realized has a constant thickness, consequently also the pad 3 has a constant thickness between its inner and outer curved sides. This feature allows a better arrangement into the pocket 8 of the energy absorbing pad 3.

Figure 1A:
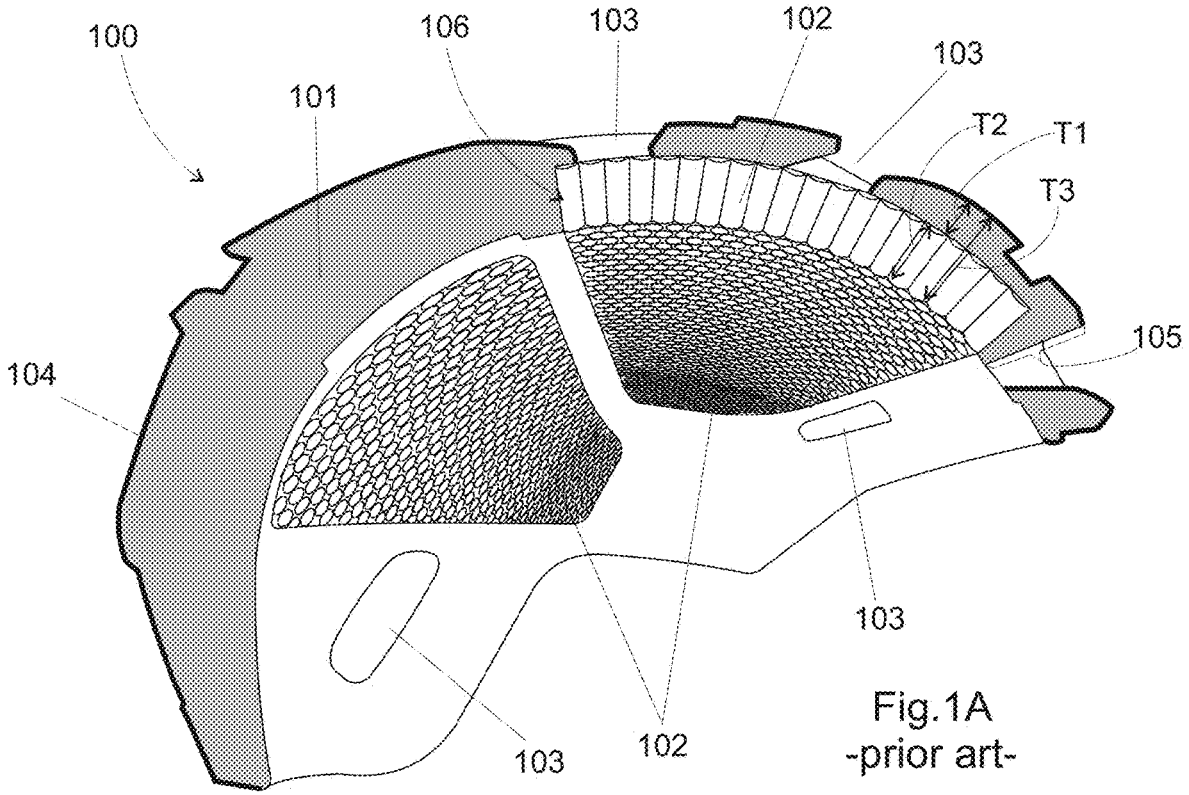
FIG. 1A shows a schematic view of a sectioned known helmet.
Figure 1B:
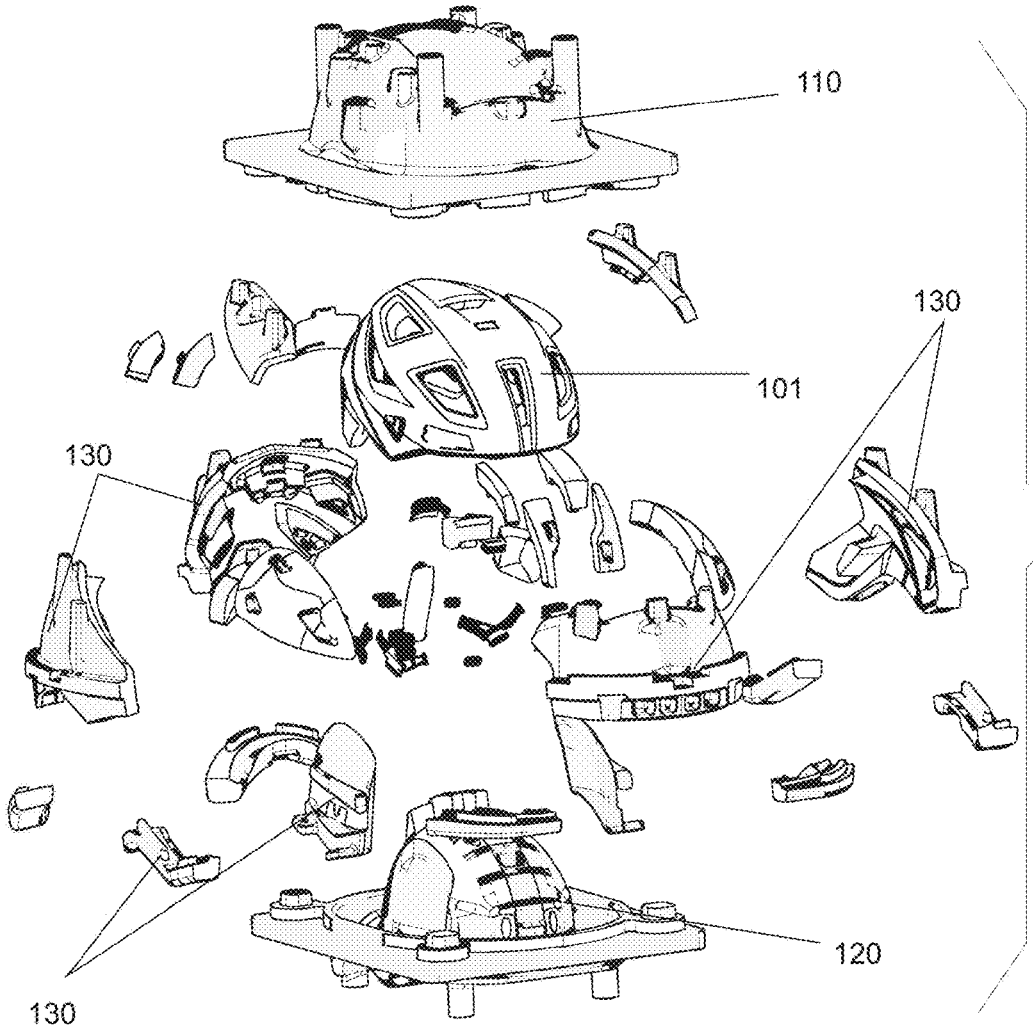
FIG. 1B shows an exploded view of the mould pieces required to mould an EPS helmet known in the art.

The helmet 1 can comprise a shell 7 as in the embodiment of FIGS. 2,3 and 7. In FIGS. 1 and 2 the shell 7 is a thin layer of PC (polycarbonate) which is thermo-molded together with the first protective collapsible portion 2 of polymeric foam.

The shell 7 can be alternatively made of ABS (acrylonitrile butadiene styrene), PE (polyethylene) or a composite material such as glassfibre or carbon fibre, and can be connected to the first protective collapsible portion 2 with glue, mechanical connections or any other connecting means.

In the FIG. 7, the shell 7 is monolithically connected to the lattice structure 17. The shell 7 can be realized together with lattice structure 3D printing both parts in the same time. In this way, they result in a single piece.

The shell 7 allows to spread the energy of an impact over a wider area of the lattice first protective collapsible portion 2. The outer shell 7, being harder than the other elements of the helmet 1, protects from stronger impacts, in particular that with sharp elements.

This outer shell 7 comprises some vents for admitting air. Each vent of the outer shell 7 is fluidly connected to a respective vent 5 of first protective collapsible portion 2.

Said first and second protective collapsible portions 2,4 comprise one or more through-holes 5',5". Corresponding through-holes 5',5" of the first and second protective collapsible portions 2,4 provide said vents 5.

Through-hole 5' of the first protective collapsible portion 2 comprise side walls which are substantially coplanar with the side walls of the through-hole 5" of the second protective collapsible portion 4, so to realize a more aerodynamic vent 5. The vents so realized lie in correspondence of the energy absorbing pad 3.

Figure 5:
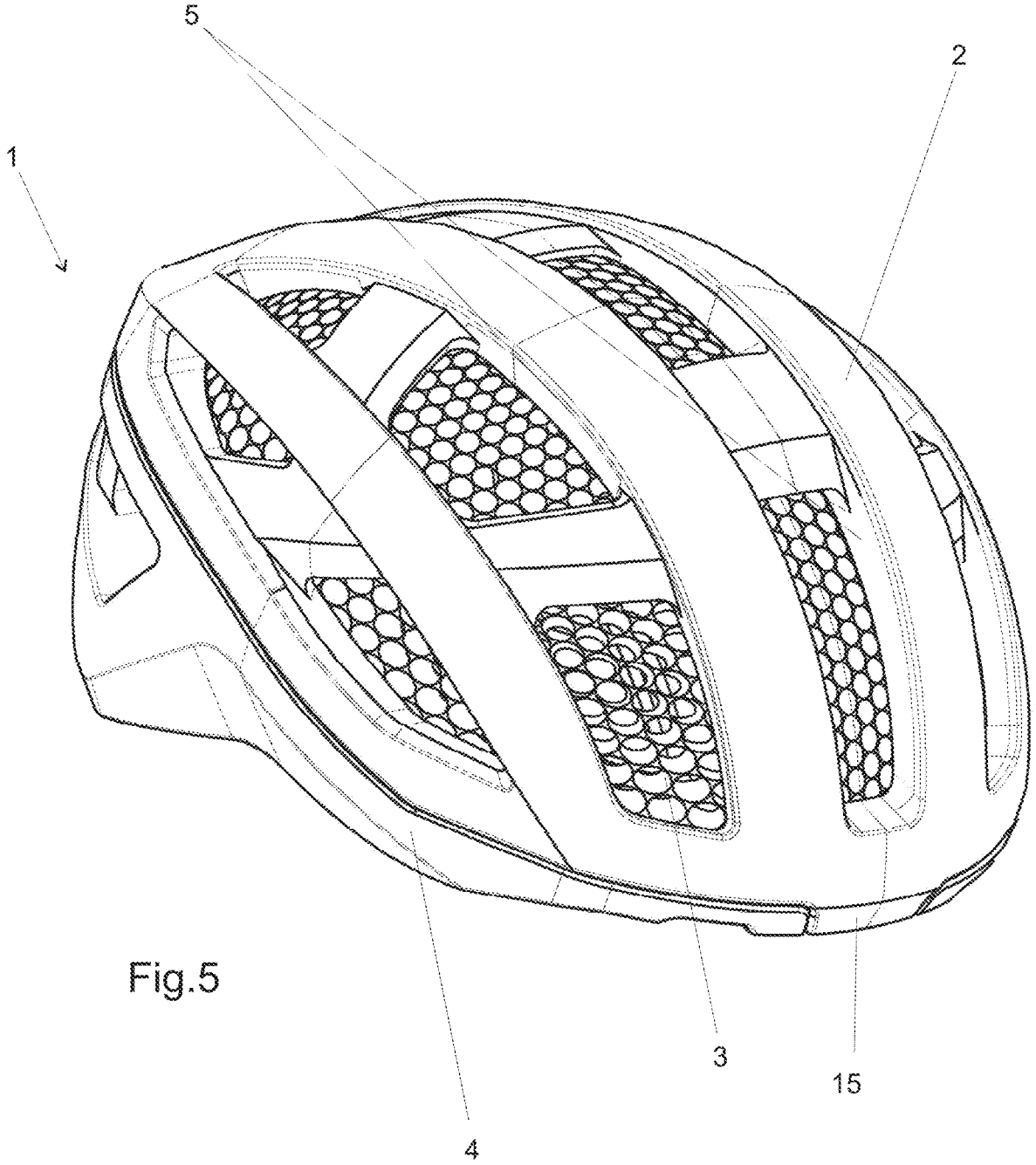
FIG. 5 shows an isometric view of a helmet according to the present invention.

Through these vents 5 pass a large volume of air, which cross the permeable energy absorbing pad 3 and reaches the user head. Indeed, through these vents 5 the energy absorbing pad 3 is visible, as shown in FIGS. 2 and 5.

The vents 5', 5" of the first and second protective collapsible portions 2,4 are smaller than the energy absorbing pad 3 so that any accidental release of the energy absorbing pad 3 from the helmet 1 is prevented.

The air can be further efficiently redistributed on the user head by means of said longitudinal channels 19 of the second protective collapsible portion 4.

Internally to the first and second protective collapsible portions 2,4 of FIGS. 2 and 3 is arranged one single energy absorbing pad 3. Both first and second protective collapsible portions 2,4 comprise a respective pocket 8 configured to admit a portion of the energy absorbing pad 3.

In the embodiment of FIG. 6, the three energy absorbing pads 3 are arranged only into respective pockets 8 of the second protective collapsible portion 4.

In a further embodiment (not shown) the at least one energy absorbing pad is arranged into the first protective collapsible portion 2.

According to previous and following embodiments, the pocket/s 8 configured to receive the energy absorbing pad 3 can be arranged entirely in the first protective collapsible portion 2, entirely in the second protective collapsible portion 4, or in part in the first protective collapsible portion 2 and in part in the second protective collapsible portion 4.

The first protective collapsible portion 2 is externally shaped like the external side of a traditional helmet, while the second protective collapsible portion 4 is internally shaped like the inner of a traditional helmet.

The first and second protective collapsible portions 2,4 are hemi-shells having complementary shapes, as shown in FIG. 5, so to overall provide the appearance of a traditional helmet, in particular of a traditional sport helmet.

In a particular embodiment, the helmet 1 comprises a breathable low friction element (not shown) arranged and connected to the inner surface of the second protective collapsible portion 4 so that this breathable low friction element faces toward the empty space 6 wherein the user's head is arranged.

Notwithstanding the helmet of the present invention is suitable for sport activities, the present scope of protection includes helmets having the same features but employed in different fields, like that of motorcycle/automotive/aircraft helmets or industrial safety helmets.

Concluding, the invention so conceived is susceptible to many modifications and variations all of which fall within the scope of the inventive concept, furthermore all features can be substituted to technically equivalent alternatives. Practically, the quantities can be varied depending on the specific technical exigencies. Finally, all features of previously described embodiments can be combined in any way, so to obtain other embodiments that are not herein described for reasons of practicality and clarity.

The invention claimed is:

1. A helmet comprising:

a first protective collapsible layer, a second protective collapsible layer, and at least one energy absorbing pad permeable to air arranged between said first and second protective collapsible layers, wherein each of the at least one energy absorbing pad comprises a plurality of cells connected to each other to form an array of energy absorbing cells, wherein the first protective collapsible layer and the second protective collapsible layer are coupled to each other;

wherein at least one cavity is formed in a portion of an inner side of the first protective layer for accommodating said at least one energy absorbing pad, so that the at least one energy absorbing pad is entirely accommodated only in the corresponding at least one cavity of the first protective collapsible layer;

wherein said first collapsible protective layer and said second protective collapsible layer are configured to fit each other;

wherein the second protective collapsible layer is dome-shaped and an additional portion of the inner side of the first protective collapsible layer, outside the cavity is shaped to mate with the second protective collapsible layer; and wherein a low friction layer/coating is applied at a separation surface between the first protective collapsible layer and the second protective collapsible layer, such that the second protective collapsible layer rotates into the first protective collapsible layer like a ball-joint; and wherein one among the first protective collapsible layer and the second protective collapsible layer comprises one or more male elements configured to engage respective one or more female elements of the other one among the first protective collapsible layer and the second protective collapsible layer, whereby a mechanical coupling between the first protective collapsible layer and the second protective collapsible layer is realized by means of the male and female elements.

2. The helmet according to claim 1, wherein the first protective collapsible layer is arranged over the second protective collapsible layer.

3. The helmet according to claim 1, wherein the first protective collapsible layer and/or the second protective collapsible layer is/are made of a closed-cell polymeric foam.

4. The helmet according to claim 1, wherein the first protective collapsible layer and/or the second protective collapsible layer comprise/s a lattice structure.

5. The helmet according to claim 1, wherein the at least one energy absorbing pad is enclosed between said first protective collapsible layer and said second protective collapsible layer.

6. The helmet according to claim 5, wherein the first protective collapsible layer and/or the second protective collapsible layer is/are shaped so as to entrap and prevent the extraction of the at least one energy absorbing pad from the helmet when the at least one energy absorbing pad is arranged between said first protective collapsible layer and said second protective collapsible layer.

7. The helmet according to claim 1, wherein at least a portion of the first protective collapsible layer is protected by a shell connected to said first protective collapsible layer.

8. The helmet according to claim 1, wherein said first protective collapsible layer and said second protective collapsible layer comprise one or more vents.

9. The helmet according to claim 1, wherein the energy absorbing pad is configured to absorb more energy through deformation than the first protective collapsible layer and/or the second protective collapsible layer.

10. The helmet according to claim 1, wherein adjacent cells of the plurality of cells of the at least one energy absorbing pad are bonded to each other via a portion of lateral surfaces.

11. The helmet according to claim 1, wherein the low friction layer/coating is also arranged between the first protective collapsible layer and the energy absorbing pad or between the energy absorbing pad and the second protective collapsible layer for allowing a relative movement between them.

* * * * *